US009958112B1

(12) United States Patent
Johnson

(10) Patent No.: US 9,958,112 B1
(45) Date of Patent: May 1, 2018

(54) MOUNTING SYSTEM FOR HOLDING ITEMS

(71) Applicant: Brian Louis Johnson, Ft. Meyers, FL (US)

(72) Inventor: Brian Louis Johnson, Ft. Meyers, FL (US)

(73) Assignee: Brian Johnson, Fort Myers, FL (US)

( * ) Notice: Subject to any disclaimer, the term of this patent is extended or adjusted under 35 U.S.C. 154(b) by 0 days. days.

(21) Appl. No.: 15/196,887

(22) Filed: Jun. 29, 2016

Related U.S. Application Data

(60) Provisional application No. 62/156,535, filed on May 4, 2015.

(51) Int. Cl.
*F16M 13/02* (2006.01)
*A47G 7/04* (2006.01)

(52) U.S. Cl.
CPC ..... *F16M 13/022* (2013.01); *A47G 7/044* (2013.01)

(58) Field of Classification Search
CPC .... F16M 13/02; F16M 13/022; F16M 11/041; F16M 11/10; F16M 13/00; F16M 2200/022; F16M 2200/027; F16M 11/14; F16M 11/08; F16M 11/24; F16M 11/046; F16M 11/2014; F16M 11/28; F16M 2200/024
USPC ..... 248/219.1, 219.3, 227.3, 228.1, 228.2, 248/230.1, 230.2, 218.4
See application file for complete search history.

(56) References Cited

U.S. PATENT DOCUMENTS 5,983,911 A * 11/1999 Steele ..... A61G 5/1094 135/66
6,325,350 B1 * 12/2001 Mancuso ..... B60N 3/103 224/274
7,641,356 B2 * 1/2010 Pieroth ..... F21L 15/10 248/214
8,336,837 B2 * 12/2012 Gephart ..... F16B 2/12 248/218.4
8,714,502 B1 * 5/2014 Davis ..... E04B 9/006 248/214
9,194,407 B1 * 11/2015 Straney ..... F16B 2/06
2007/0034758 A1 * 2/2007 Bates ..... E04H 12/2276 248/218.4
2011/0147554 A1 * 6/2011 Liao ..... F16B 2/12 248/226.11

* cited by examiner

*Primary Examiner* — Steven M Marsh
(74) *Attorney, Agent, or Firm* — Steven M. Koehler; Westman, Champlin & Koehler, P.A.

(57) ABSTRACT

A mounting system for attaching items on railing spindles includes a plurality of rails, a fastener, and a rail hook for attaching accessories. The mounting system is configured to removably mount the rails to railing spindles without causing damage to the railing spindles, wherein the fastener is comprised of a first element configured to engage a surface of a flanged aperture on a second rail, and a second element configured to engage a first and second major surface of a first rail through aligned apertures of the first rail. The rail hook is then selectively attachable to the plurality of rails, wherein a plurality of accessories may be attached to the rail hooks for attaching items to railing spindles.

19 Claims, 10 Drawing Sheets

MOUNTING SYSTEM FOR HOLDING ITEMS

CROSS-REFERENCE TO RELATED APPLICATIONS

The present application is based on and claims priority of U.S. provisional patent application Ser. No. 62/156,535, filed May 4, 2015, the content of which is hereby incorporated by reference in its entirety.

BACKGROUND

The discussion below is merely provided for general background information and is not intended to be used as an aid in determining the scope of the claimed subject matter.

The present invention is in the technical field of mounting systems. More particularly, the present invention is in the technical field of mounting systems for selectively attaching items to a railing spindles or the like. The vast majority of fence or railing mounted hangers, such as planter hangers or bird feeders, are permanently mounted using screws, nails and/or bolts to attach items to handrails, spindles, or posts. Further, items that hang over handrails, such as planter boxes, will often scratch and create physical damage. Once these items are removed, the material is damaged due to the marks and holes left behind, and the material will require replacement or repair. Moreover, items that hang over the top of handrails will stop the handrail from being used as a handrail, thus blocking its intended purpose.

SUMMARY

This Summary and Abstract are provided herein to introduce a selection of concepts in simplified form that is further described below in the Detailed Description. The Summary and Abstract are not intended to identify key features or essential features of the claimed subject matter, nor is it intended to be used as an aid in determining the scope of the claimed subject matter. The claimed subject matter is not limited to the implementations that solve any or all the disadvantages noted in the background.

A mounting system for attaching items on railing spindles includes a plurality of rails and a plurality of fasteners, configured to removeably mount the rails on the spindles of a railing without damaging the railing spindles. The mounting system can include a first rail having aligned apertures on a first and second major surface, and a second rail having a third major surface with a flanged aperture. The first and second rail may then be attached by a fastener having a first element configured to engage the flanged aperture of the second rail and a second element configured to engage the aligned apertures of the first rail. A plurality of rail hooks may then be selectively attachable or detachable to the plurality of rails as the means for attaching accessories on railing spindles. When attached, the rail hooks may then be slidable along the rail.

In further embodiments, the mounting system can include one or more of the following features. The mounting system can include multiple rails, with a third rail containing multiple flanged apertures to be engaged to fasteners connected to a first and second rail. For instance, the third rail may be of varying but greater length compared to a first and second rail, thereby allowing a greater area for hanging items on railing spindles. The flanged apertures of the third rail may also be aligned in different configurations, enabling the rails to be mounted in a different manner on railing spindles.

The accessories can include a plurality of features enabling a plurality of items to be attached to railing spindles. The accessories can include various loops of different sizes configured as planter rings to hang plants, the loops attached to rail hooks, and the rail hooks selectively attachable to a rail. The accessories may also include shelves, shelf brackets, adjustable brackets, hooks, hangers or extension hangers, but the accessories need not be so limited. A plurality of accessories may be attached by means of rail hooks to a plurality of rails.

DETAILED DESCRIPTION

The description herein is not to be taken in a limiting sense, but is made merely for the purpose of illustrating the general principles of the system described herein.

Figure 1:
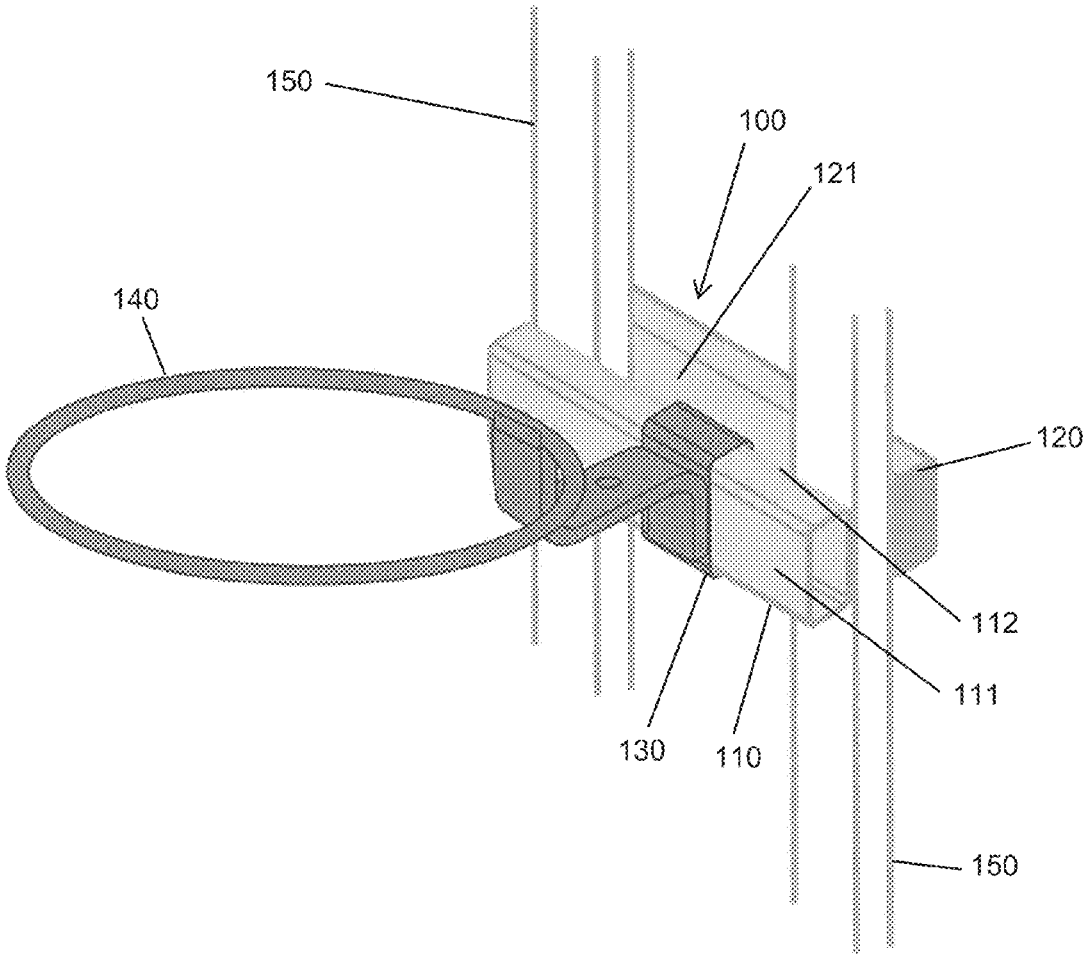
FIG. 1 is a perspective view of an embodiment of a mounting system mounted on railing spindles.

A mounting system 100 for mounting various accessories, one of which is indicated at 140, on railing spindles 150 is illustrated in FIG. 1. The mounting system 100 generally includes a first rail 110 with a first major surface 111 and a second major surface 112 and a second rail 120 with a third major surface 121. The first rail 110 and the second rail 120 can be placed on opposite sides of spindles 150 of a railing and then fastened with a fastener to secure the mounting system 100 with the spindles 150 clamped between the rails 110 and 120.

A rail hook 130 may be selectively attached to either the first rail 110 or second rail 120. The rail hook 130 is a coupling member that couples to one of the rails and in effect forms a base upon which various support elements are joined to form the various accessories such as hanging accessory 140. It should be noted that the rail hook can be removably attached or fixedly secured to the rail hook 130.

As illustrated in FIG. 1, in one embodiment, the mounting system 100 may include two rails, a first rail 110 mounted on one side of railing spindles 150 and a second rail 120 mounted on the opposite side of the spindles 150. Typically, the first rail 110 is aligned with the second rail 120. In the embodiment of FIG. 1, the mounting system 100 has two rails of equal length. However, in the embodiment illustrated in FIGS. 2 and 3, the mounting system 200 is composed of three rails of different lengths enabling greater space for attaching rail hooks with accessories. Hence, the length of each rail and the number of rails is not limiting.

Figure 2:
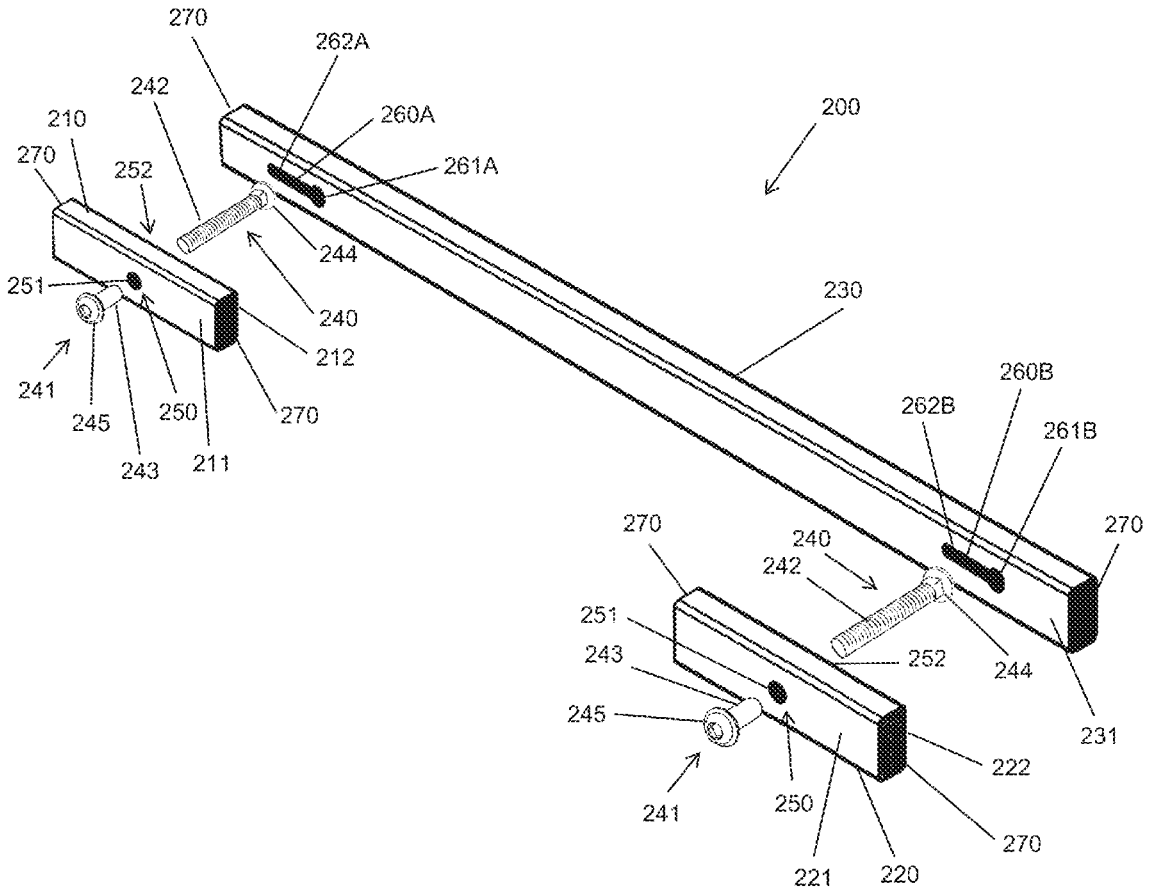
FIG. 2 is perspective view of an embodiment of a mounting system with support three rails.

In FIG. 2, the mounting system 200 generally includes a first rail 210 and a second rail 220 fastened to a third rail 230 with fasteners 240. The first rail 210 and second rail 220 each contain a first major surface and a second major surface with aligned apertures 250. The first rail 210 has a first major surface 211 and a second major surface 212 that is in an opposite facing direction from the first major surface 211. The second rail 220 has a first major surface 221 and a second major surface 222 that is in also an opposite facing direction from the first major surface 221. The first and second rails 210, 220 have aligned apertures 250 through the first major surfaces 211, 221 and the second major surfaces 212, 222. The third rail 230 has a third major surface 231 which contains flanged apertures 260. The first rail 210, second rail 220, and third rail 230 may then be secured to the spindles 150 when the apertures 250 and the flanged apertures 260 are aligned with fasteners 240 extending therethrough.

As illustrated in FIG. 2, the fastener 250 may comprise threadably engaging components. The fastener 250 may include a nut 241 that in one embodiment can be inserted through at least one of the apertures 250 of a first and second rails 210, 220 of first major surface 211, 221 and, if desired, extend also through the second apertures 252 in second major surface 212, 222. A bolt 242 engages the third rail 230 and is selectively fastened to the nut 241 where the bolt 240 extends between the space of adjacent spindles (now shown in FIG. 2). In one embodiment, the bolt 242 is configured so as to engage flanges of the flanged aperture 260 such as where the bolt 242 can comprise a carriage bolt with an enlarged head that is disposed inside the third rail 230. The nut 241 may be a sleeve nut with an internal thread configured to receive the bolt 242, but the fastener need not be so limited.

In one particular form, the flanged apertures 260 on the third major surface 231 of the third rail 230 are comprised of an enlarged aperture 261 A,B configured to allow the head of the bolt 240 to extend therethrough and a narrow slot 262 A, B that the head cannot extend therethough. The third rail 230 may then be orientated such that the head or end of the fastener 240 slides within the third rail with a rod of the fastener oriented so as to extend toward the first and second rail 210, 220. When the nuts 241, comprising a first member of the fastener 240, are secured to the first and second rails, herein by extending through at least apertures 252 and then coupled to a second member of the fastener 240, herein be threaded upon ends of the bolts 242, the first and second rails 210,220 are drawn toward the third rail 230 so as to clamp upon opposite facing surfaces of the spindles. It should be noted that since that the end of the fastener 242 is configured to extend into but not through the third rail 230, the major surface of the third rail facing in a direction opposite to that of major surface 231 is devoid of any apertures or portions of the fasteners so as to provide a uniform or "clean" surface. In one embodiment, the nut 241 may be a sleeve nut, with a head 245 and a shank 243, the shank 243 further containing internal threads to receive the threaded fastener 242. In another embodiment, the aperture 251 of the aligned apertures 250 may be recessed to receive the head 245 of the nut 241 creating a generally flush surface on the first major surface 211, 221 enabling the rail hook 230 to freely slide along a first and second rail 210, 220, and if desired cover the head 245 of the nut 241. If desired, end plugs 270 may be inserted into the ends of the rails 210, 220, 230 when the rails are made from tubing.

Figure 3:
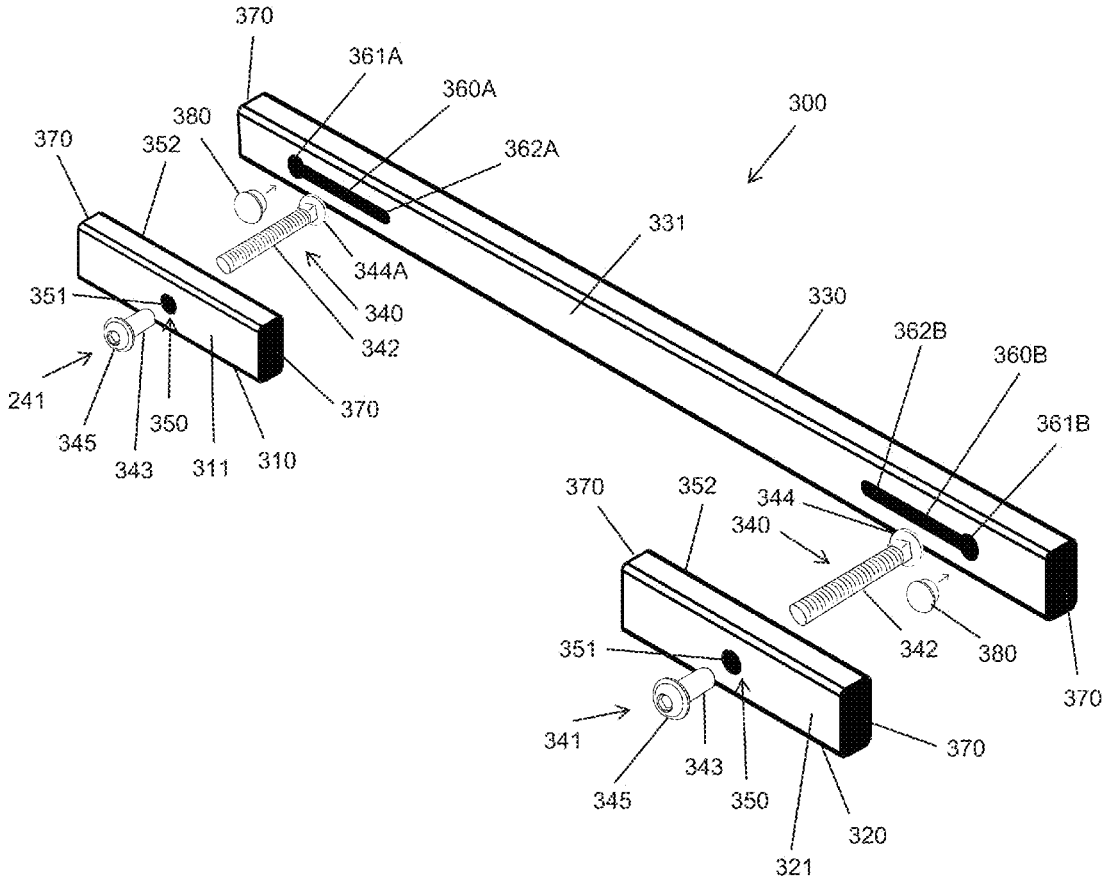
FIG. 3 is a second embodiment of the mounting system.

The embodiment of FIG. 3 is similar to the embodiment of FIG. 2. However, in this embodiment the flanged apertures 360 on the third major surface 331 of the third rail 330 are in opposing alignment to each other rather than oriented in the same direction and manner as illustrated in FIG. 2. The embodiment of FIG. 3 is assembled in a manner similar to that described above. However, this embodiment further comprises slot plug 380 which may be inserted into the enlarged aperture 361 of flanged aperture 360 and is configured to inhibit the head of the fastener 242 from exiting through the enlarged aperture 361.

If desired, the mounting system can comprise a plurality of fasteners, or components thereof, so as to provide vary the length of the fastener when used enabling the system to be mounted on a variety of railings having spindles. In particular, railing spindles may be of various shapes, such as round, square or oblong, and be of various sizes and widths. By first measuring the depth of the railing spindles, the appropriate fastener may then be chosen. The mounting system contains a plurality of fastener lengths to ensure a tight connection of the mounting system on a variety of spindles with many different sizes. The mounting system may also use rails of a plurality of sizes and lengths to meet a variety of mounting requirements. In one embodiment, a kit includes at least two rails with the apertures discussed above and fasteners of different lengths that all can be used with the nut provided. In this manner, depending on the size or width of the spindles, a carriage bolt of sufficient length is used such that the fastener operatively extends between the rails, providing a sufficient clamping force upon the spindles, while retaining the head of the bolt within the second rail.

Once mounted, the mounting system is configured to receive one or more rail hooks 230 as described above that in turn support various accessories. The rail hook 230 is configured to be complementary to at least a portion of the external shape or perimeter of at least one of the rails. However, in a further advantageous embodiment two or more of the rails have the same external shape or perimeter allowing the rail hook 230 to be mounted selectively to two or more of the rails where desired.

Figure 4:
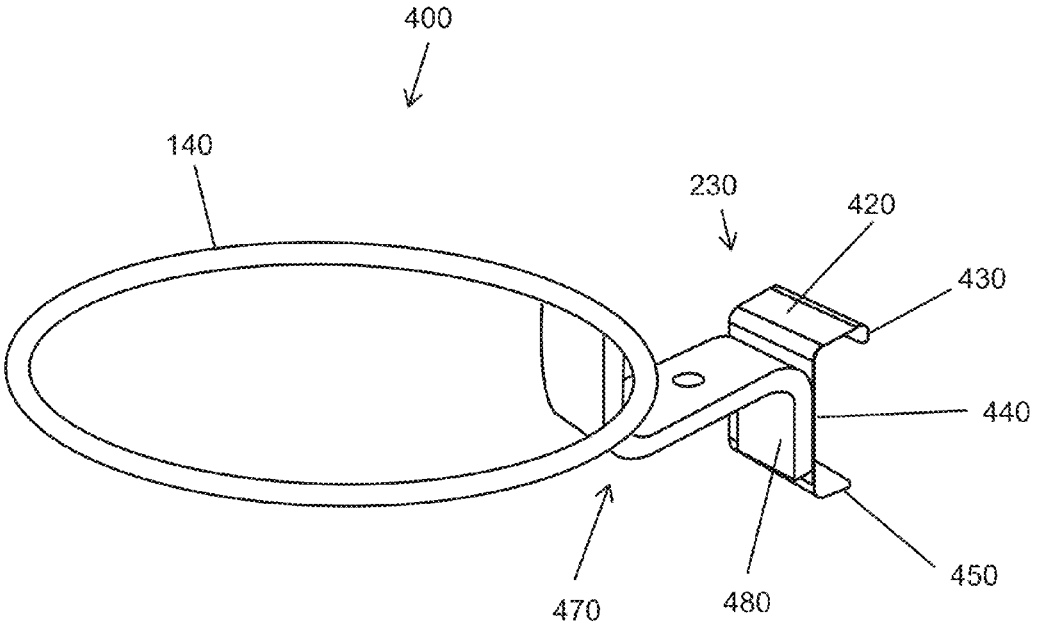
FIG. 4 is a perspective view of an embodiment of a mounting system accessory comprising a support loop.

The rail hook 230 is configured to easily attach and detach from the mounting rail(s) e.g. 210, 220 or 230 by attaching to the rail, and once attached, in one embodiment, is further slidably adjustable along the rail. In one advantageous example, the rail may be a tube in a square C shape, with the rail hook 230 being complementary to a portion of the external shape of the rail and configured to overlap and/or engage portions of each of the four sides of the square rail. Referring to FIG. 4, in one embodiment, the rail hook 230 may be comprised of a single integral piece formed of a unitary body containing three bends. The rail hook 230 may be generally C shaped having a top support 420 engaging and/or overlapping an upper surface of the rail, a vertical support 440 engaging and/or overlapping one of the major surfaces described above, a bottom support engaging and/or overlapping a lower surface of the rail and a lip or flange 430 engaging and/or overlapping a portion of a major surface facing in a direction opposite to that of the surface engaged and/or overlapping by vertical support 440.

As mentioned above, the first rail 111 of FIG. 1 or the first and second rail of FIGS. 2 and 3 may contain a recessed aperture 251, 351 in the first major surface. The recessed aperture 251, 351 is configured to the nut head 245, 345 creating a flush first major surface on a first or second rail when the nut 245 is inserted through the aligned apertures 250. The flush surface of the first major surface 211, 221 enables the rail hook 230 to adjustably slide along and over the nut 245, if desired, along the entire length of the first major surface 211, 221 when attached.

The mounting system further comprises at least one and possibly a plurality of accessories attachable to rails with associated rail hooks. These accessories may include a variety of shapes and sizes to meet a variety of hanging needs. In FIG. 1, the mounting system 100 demonstrates an accessory 140 attached to the rail hook 130. In this embodiment the accessory 140 is a support loop configured to receive a container partially therethrough, but the embodiment need not be so limited.

FIG. 4 illustrates an accessory similar to the accessory 140 of FIG. 1. Accessory 400 contains a loop 490 attached to a rail hook 410 for selectively attaching the accessory 400 to a mounting rail. The rail hook 410 is comprised of a top length 420, a vertical lip 430, a vertical length 440 attached to the top length 420, the vertical length further attached to a bottom length 450. The accessory loop 490 is attached by an accessory arm 480 to the vertical length 440 of the rail hook 410. By these means a planter ring may be attached or detached to a rail of the mounting system as described in FIG. 1, 2, or 3. The loop 490 may be of various sizes to accommodate a plurality items. For example, the loop may be configured as a planter ring for holding potted plants and so a loop of appropriate size may be selected to hang a plurality of items of various sizes.

Figure 5:
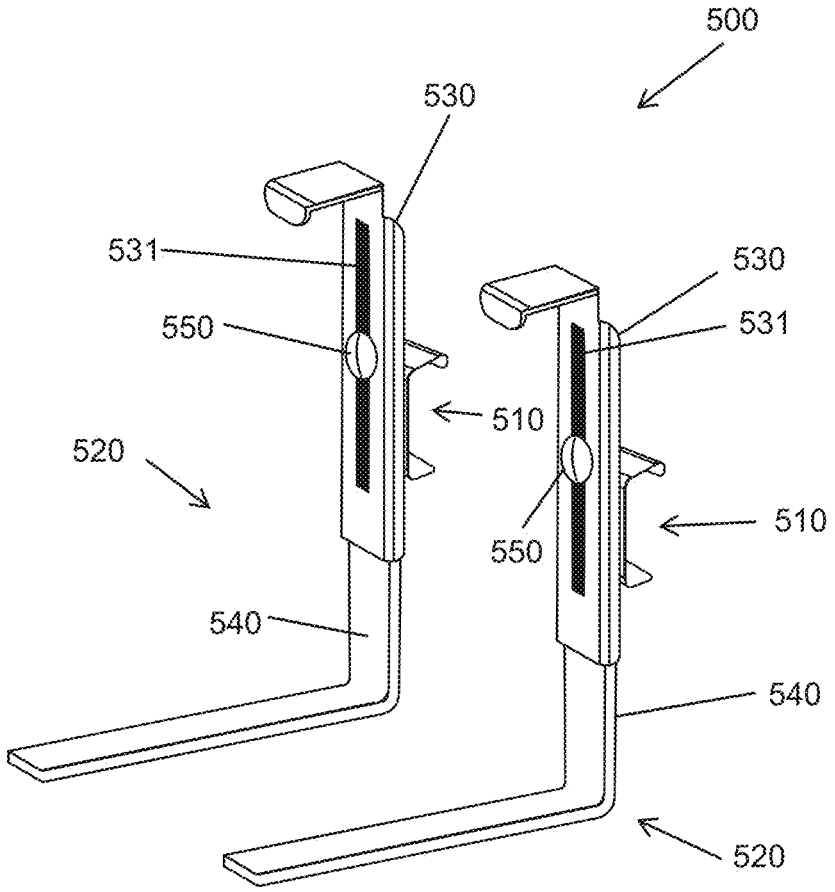
FIG. 5. is a perspective view of an embodiment of a mounting system accessory with adjustable support brackets.

FIG. 5 illustrates an accessory 500 comprising adjustable brackets 520 attached to rail hooks 510 each similar to rail hook 230. Each adjustable bracket 520 contains an upper bracket 530 slidably attachable to a lower bracket 540, upper bracket 520 and lower bracket 530 containing apertures 521 which may be aligned and adjustably secured by fastener 550. The adjustable bracket 520 is configured to be selectively adjusted to a plurality of sizes by means of securing the fastener 550 in a variety of positions. A plurality of adjustable brackets 520 may be attached to a rail (not shown) by means of the rail hook 510 to attach items to railing spindles.

Figure 6:
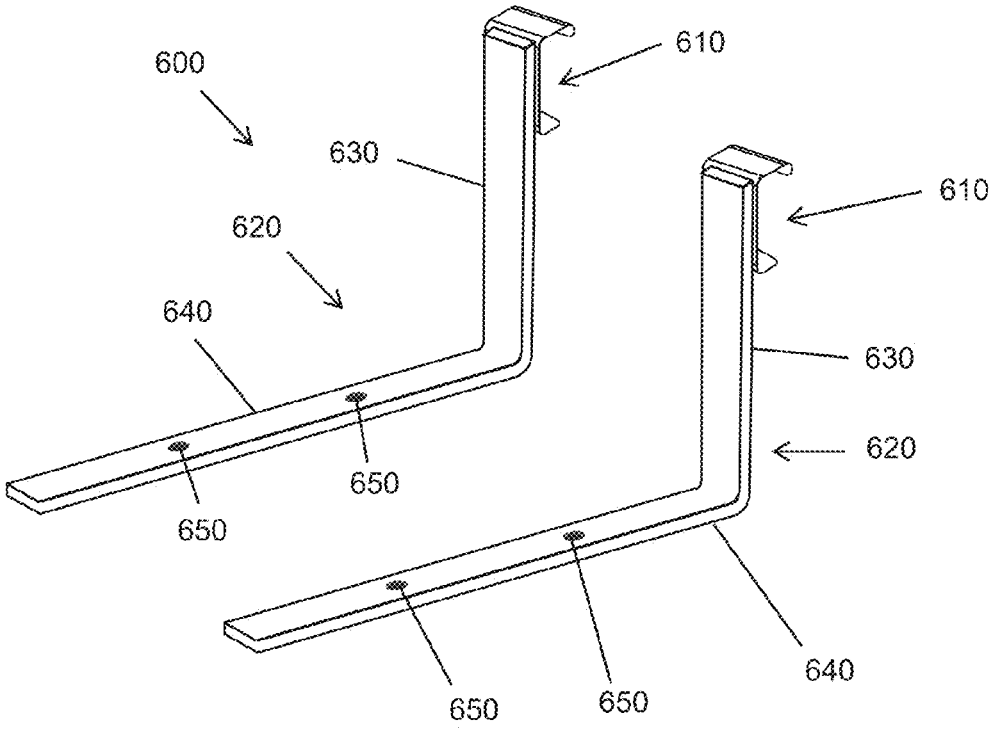
FIG. 6 is a perspective view of an embodiment of a mounting system accessory with shelf hooks.
Figure 7:
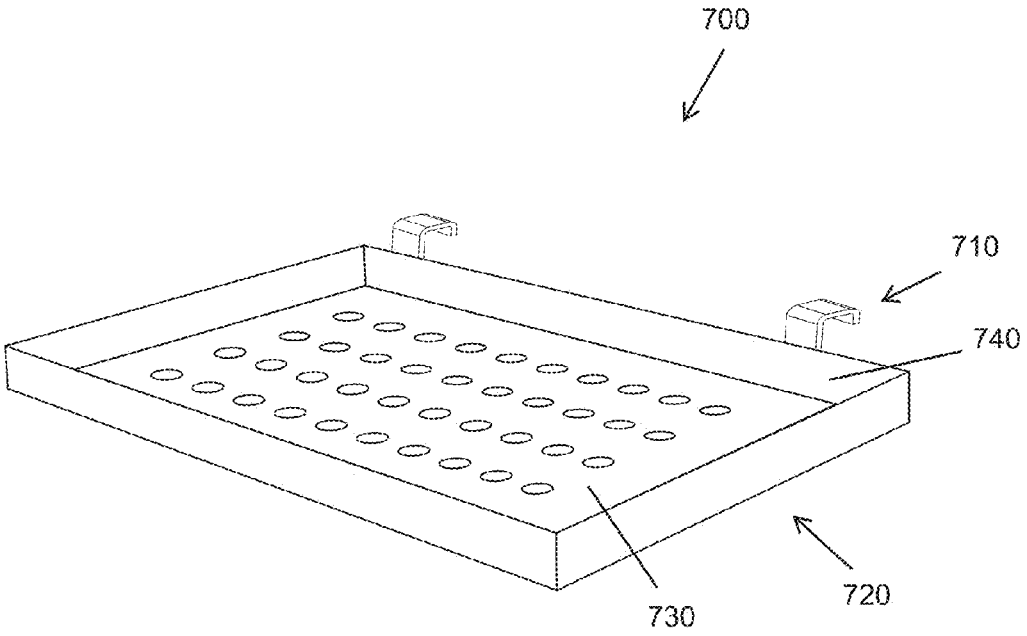
FIG. 7 is a perspective view of an embodiment of a mounting system accessory with a shelf.

FIG. 6 illustrates an accessory 600 comprising shelf hooks 620 attached to rail hooks 610 each similar to rail hook 230. Shelf hooks 620 comprise a vertical support 630 connected to a horizontal support 640, the shelf hooks 620 are further attached to rail hook 610 at the vertical support 630. Horizontal supports 640 may further contain apertures 650 for fixing items to the shelf hook 620. FIG. 7 illustrates an accessory 700 comprising shelf 720 attached to rail hooks 710. Shelf 720 comprises a horizontal shelf 730 attached to vertical side walls 740, one side of the vertical side walls 740 attached to a plurality of rail hooks 710 to be selectively attached to a rail mounting system.

Figure 8:
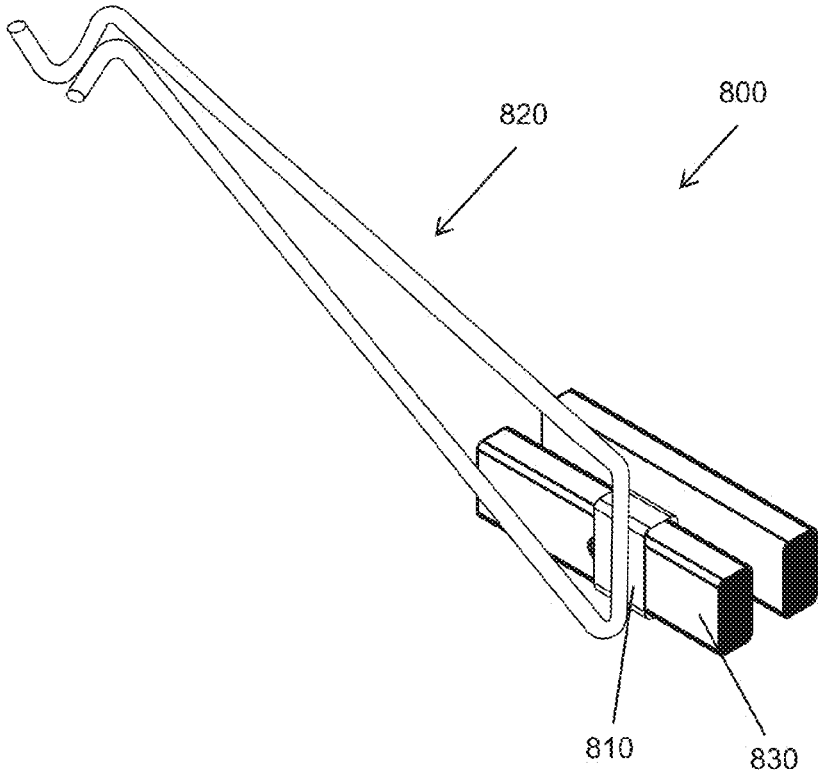
FIG. 8 is a perspective view of an embodiment of a mounting system accessory with an extension hanger.

FIG. 8 illustrates an accessory 800 comprising an extension hanger 820 attached to a rail hook 810 similar to rail hook 230, the rail hook further selectively attachable to a rail 830.

Figure 9:
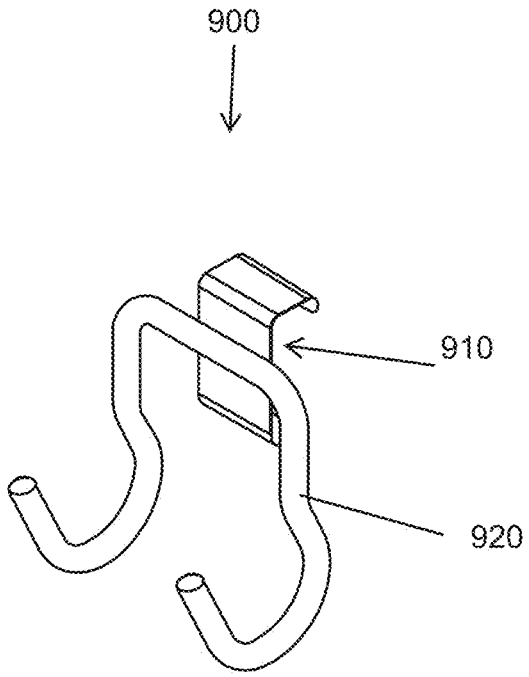
FIG. 9 is a perspective view of an embodiment of a mounting system accessory with support hooks.

FIG. 9 illustrates an accessory 900 comprising hooks 920 attached to rail hook 910 similar to rail hook 230, wherein the hooks 920 contain a plurality of hooks for hanging items on railing spindles.

Figure 10:
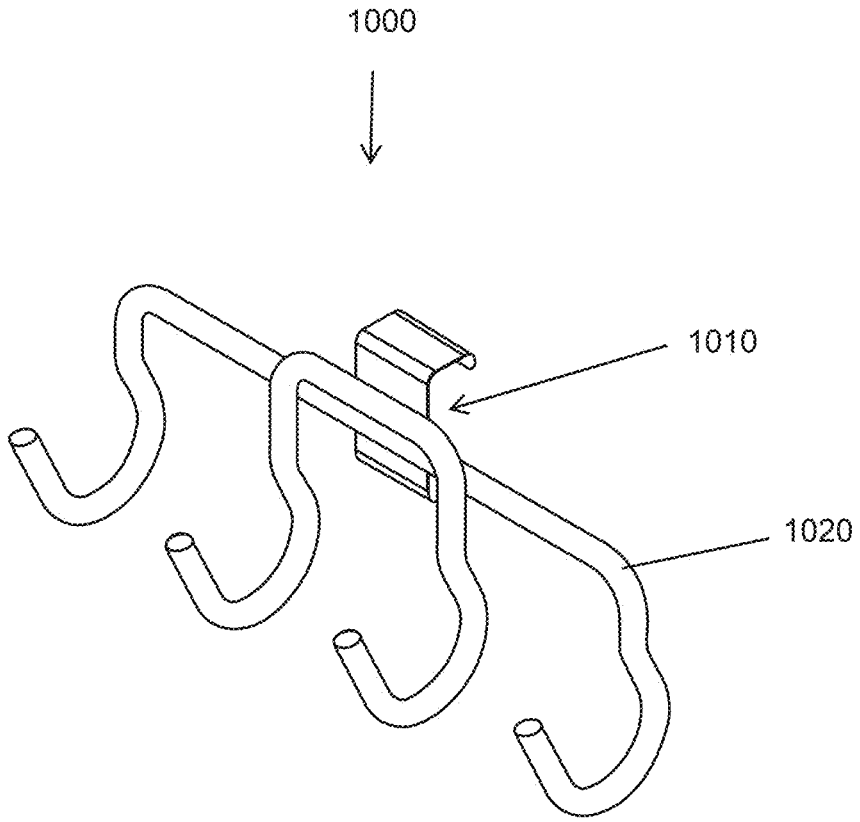
FIG. 10 is a second embodiment of the mounting system accessory of FIG. 9.

FIG. 10 illustrates a further embodiment of FIG. 9 wherein the accessory 1000 comprising hooks 1020 attached to rail hook 1010 similar to rail hook 230 contain four hooks for hanging items on railing spindles. Although the hooks of FIGS. 9 and 10 contain specific numbers of hooks, one skilled in the art may realize that a plurality of hooks may be attached to a plurality of rail hooks, and therefore not take this in a limiting sense but merely as an illustration of the general principles described herein.

It should be noted in another embodiment of the mounting system, a plurality of accessories may be attachable to a plurality of rails. For example, in FIG. 2, a plurality of accessories may be selectively attachable to a first rail 210, a second rail 220, and/or a third rail 230. In this way, a variety of items may be attached to both sides of railing spindles without the need for multiple mounting systems.

The mounting system may be comprised of a variety of materials. In one embodiment, all items may be formed from iron and powder coated with a durable paint finish. For example, the rails 210, 220, 230 of FIG. 2 may be formed as metal tubes and then powder coated with a durable paint finish. The end plugs 270 may be formed from plastic and inserted into the rails for aesthetic purposes and block moisture. The rail hook 410 may be formed from stock iron and pressed into a shape complementary to the rail. The accessory 490 may also be formed from iron and shaped into a loop. However, the embodiments need not be so limited. The materials used to make a mounting system could utilize a plurality of materials including plastic, wood, or a composite of other materials, and the examples provided are merely for the purpose of illustrating the general principles described herein.

In further embodiment, a rail of the mounting system could be mounted to a structure, such as a wall, through a fastener attached to the structure and engaged with the flanged apertures of a rail. By this means, a plurality of accessories may be selectively attachable to the structure by rail hooks selectively attached to the rail, thereby eliminating the opposing rails required when the mounting system is mounted on railing spindles.

Although the subject matter has been described in a language specific to structural features, it is to be understood that the subject matter defined in the appended claims is not necessarily limited to the specific features described above. Rather, the specific features and acts described above are disclosed as example forms of implementing the claims.

What is claimed is:

1. A mounting system for attaching items on railing spindles, the mounting system comprising:

a plurality of rails comprising:

at least a first rail having a first major surface, and a second major surface facing in a direction opposite the first major surface, the first and second major surfaces having first and second aligned apertures, respectively;

at least a second rail, having a third major surface with a flanged aperture comprising a first portion being an elongated slot of selected width perpendicular to elongation of the slot and a second portion having a width greater than the selected width of the elongated slot, and a fourth major surface facing in a direction opposite the third major surface, the fourth major surface being devoid of any aperture;

a fastener having, a first element having an end of size insertable into the second portion and larger than the selected width so as to be slidable along the slot and configured to engage a surface of the flanged aperture facing away from the first rail;

a second element configured to engage the first major surface, the first and second elements being connectable together with portions of the fastener extending through the first and second aligned apertures of the first rail; and a rail hook selectively attachable to and slidably engaging with one of the rails.

2. The mounting system of claim 1, wherein the first aperture of the first major surface of the first rail is recessed.

3. The mounting system of claim 1, wherein the second element of the fastener includes a sleeve nut insertable through the first aperture of the first major surface of the first rail and extending through the second aperture of the second major surface of the first rail.

4. The mounting system of claim 1, wherein the first element of the fastener includes a carriage bolt configured to engage the flanged aperture of the third major surface facing away from the first rail.

5. The mounting system of claim 4, and further comprising a plurality of carriage bolts of different lengths.

6. The mounting system of claim 1, and further comprising end plugs insertable in the ends of the plurality of rails.

7. The mounting system of claim 1, wherein the rail hook is complementary in shape to at least one of the rails and further comprises:

a top support;

a vertical support connected to the top support;

a bottom support connected to the vertical support; and a vertical lip connected to the top support and configured to engage a surface of the rail facing away from a surface adjacent the vertical support.

8. The system of claim 1, wherein the rail hook is adjustably slidable over the rail.

9. The system of claim 1, wherein the first rail is of the same length as the second rail.

10. The system of claim 1, wherein one of the rails is longer than another rail.

11. The system of claim 1, wherein the mounting system includes a plurality of flanged aperture plugs configured to be secured into the flanged aperture of the third major surface.

12. A system for attaching items on railing spindles comprising:

a first rail configured to be located on one side of a spindle of a railing;

a second rail configured to be located on an opposite side of the spindle of the railing, the second rail having on a first major surface an aperture comprising a first portion being an elongated slot of selected width perpendicular to elongation of the slot and a second portion having a width greater than the selected width of the elongated slot, and a second major surface facing in a direction opposite the first major surface, the second major surface being devoid of any aperture;

a fastener having a first element securable to a second element, the first element being secured to the first rail and the second element being secured to the second rail;

a removable rail hook selectively attachable to and slidably engaging the second rail; and a hanging accessory attached to the rail hook.

13. The system of claim 12 wherein the first element is removably attached to the first rail.

14. The system of claim 13 wherein the first element extends through an aperture in the first rail.

15. The system of claim 14 wherein the second element extends through a second aperture in the second rail.

16. The system of claim 14 wherein the first element extends through aligned apertures in parallel surfaces of the first rail.

17. The system of claim 13 wherein the first element extends through aligned apertures in parallel surfaces of the first rail.

18. The system of claim 17 wherein the first element and the second element comprise a threaded nut and threaded bolt, respectively.

19. The system of claim 18 and further comprising a second threaded bolt of length different than the second element, the second threaded bolt mating with the threaded nut.

* * * * *